United States Patent [19]

Preston et al.

[11] 4,036,239

[45] July 19, 1977

[54] HOPPER FOR A CIGARETTE MAKING MACHINE

[75] Inventors: Edward G. Preston; Jan A. Rakowicz, both of London, England; Francis A. M. Labbe, Neuilly-sur-Seine, France

[73] Assignee: Molins Limited, London, England

[21] Appl. No.: 681,097

[22] Filed: Apr. 28, 1976

[30] Foreign Application Priority Data

May 2, 1975 United Kingdom ..... 18394/75

[51] Int. Cl.[2] ..... A24B 1/02; A24B 7/14

[52] U.S. Cl. ..... 131/109 R; 131/110

[58] Field of Search ..... 131/109 R, 109 B, 108, 131/110, 21 R, 21 A, 130, 84 R, 84 C, 145, 55

[56] References Cited

U.S. PATENT DOCUMENTS

| | | | |
|---|---|---|---|
| 2,039,085 | 4/1936 | Kinker, Jr. | 131/130 |
| 2,488,844 | 11/1949 | Arelt | 131/109 R |
| 2,989,055 | 6/1961 | Labbe | 131/109 R X |
| 3,036,578 | 5/1962 | Molins | 131/109 R X |
| 3,532,099 | 10/1970 | Fuchu et al. | 131/84 C |

FOREIGN PATENT DOCUMENTS

| | | |
|---|---|---|
| 1,190,713 | 10/1959 | France |

*Primary Examiner*—Stephen C. Pellegrino
*Attorney, Agent, or Firm*—John C. Smith, Jr.

[57] ABSTRACT

A cigarette machine hopper comprises a first spiked band having an operative run; means for feeding tobacco onto the operative run of the first band; a second spiked band having an operative run adjacent to and approximately parallel to the operative run of the first band and arranged to move at a speed different from that of the first band, the spikes of the two bands being arranged to intercalate and to tease the tobacco and/or stretch lumps in the tobacco as the tobacco is fed forwards between the bands.

15 Claims, 4 Drawing Figures

HOPPER FOR A CIGARETTE MAKING MACHINE

This invention is concerned with a hopper for a cigarette making machine. The hopper commonly serves to feed an even stream of tobacco, usually in the form of a loose "carpet", to the cigarette filler forming part of the machine.

According to this invention a cigarette machine hopper comprises a first spiked band having an operative run; means for feeding tobacco onto the operative run of the first band, a second spiked band having an operative run adjacent to and approximately parallel to the operative run of the first band and arranged to move at a speed different from that of the first band, the spikes of the two bands being arranged to intercalate and to tease the tobacco and/or stretch lumps in the tobacco as the tobacco is fed forwards between the bands.

The term "spiked band" is intended to include a band carrying slats (e.g. extending across the band at regular intervals) which project from the surface of the band and have their outer edges notched at regular intervals to form a scalloped or saw-tooth shape, the teeth between the notches serving as spikes.

Examples of hoppers according to this invention are shown in the accompanying drawings. In these drawings.

Figure 1:
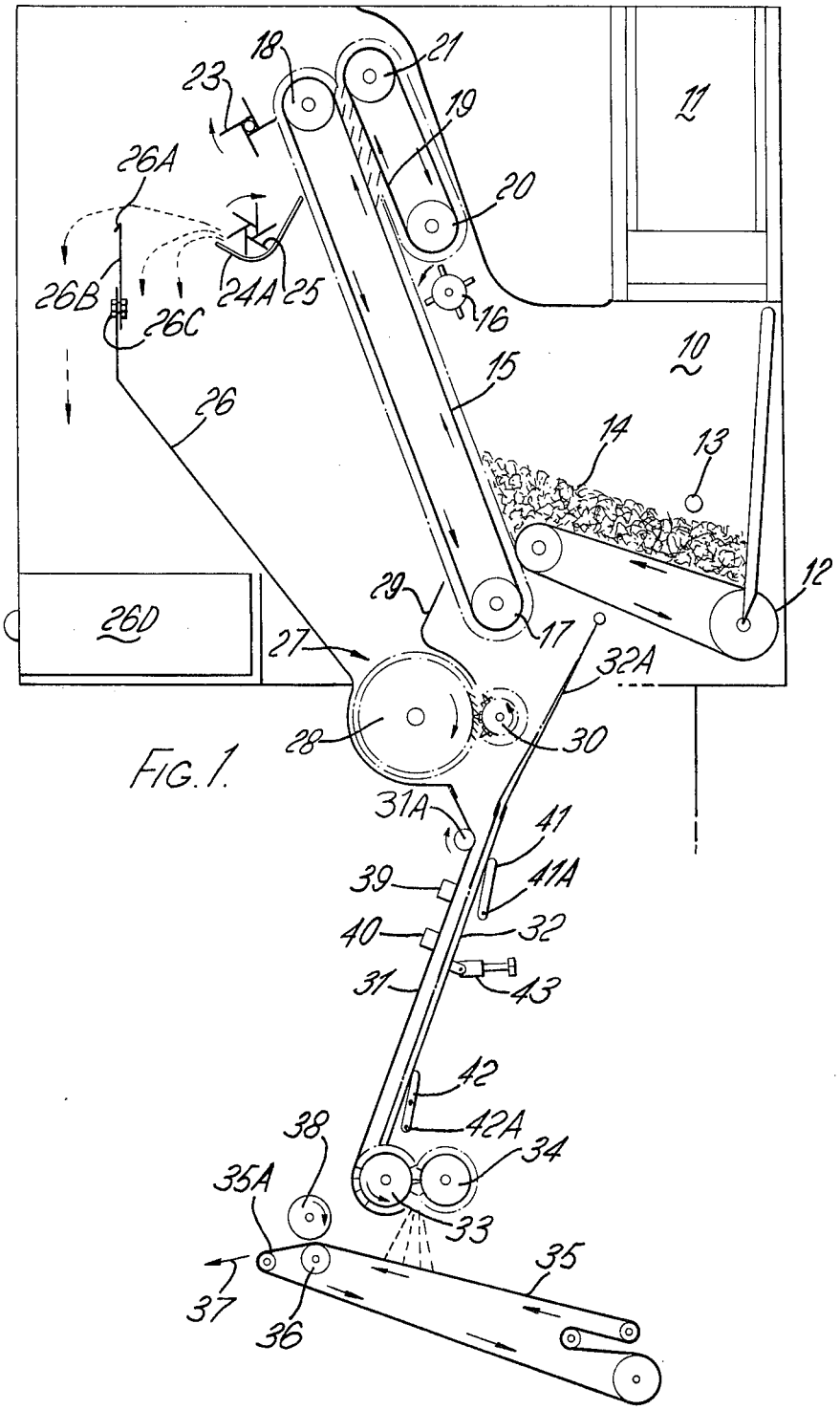
FIG. 1 is a diagrammatic elevation of one hopper.

The hopper shown in FIG. 1 includes a supply space 10 into which tobacco is delivered from time to time, when required, by a discharger unit 11. A band 12 forms the floor of the space 10 and moves continuously in the direction shown. At a preset (possibly adjustable) distance above the band 12 there is a sensor unit, for example a photo-cell unit 13, which controls the delivery of tobacco into the space 10 so as to maintain a carpet of tobacco 14 of approximately uniform thickness on the band 12; the carpet preferably has a thickness within the range 50 to 200 mm. The unit 11 may receive tobacco pneumatically, such arrangements being already well known.

Figure 2:
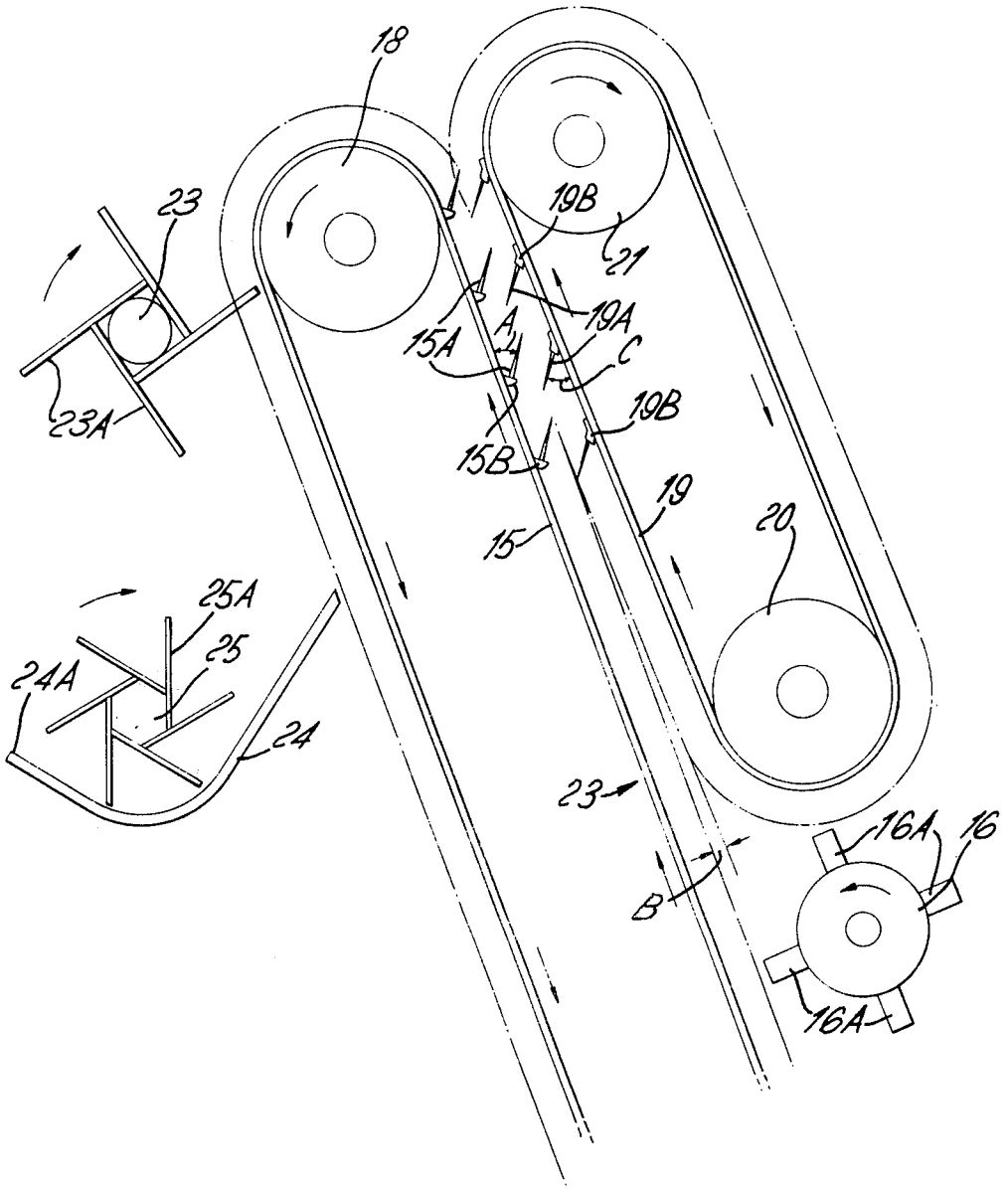
FIG. 2 is an enlargement of part of the hopper shown in FIG. 1.

The left-hand side of the space 10 is bounded by the operative upwardly-moving run of a first spiked band 15. As shown in FIG. 2, spikes 15A on the band 15 lie in rows which extend across the band and are mounted on mounting strips 15B secured to the band. The spikes are forwardly inclined, the angle A between the spikes and the band (see FIG. 2) being approximately 41°. Thus the band 15 carries tobacco upwards from the end of the carpet 14. Any lumps protruding excessively from the band 15 are knocked off by a roller 16 rotating in the direction shown in FIG. 2 and formed with four axial ribs 16A.

The band 15 passes around pulleys 17 and 18.

In accordance with this invention, there is a second spiked band 19 which has an operative run adjacent to and approximately parallel to the operative run of the band 15. The band 19 passes around pulleys 20 and 21. The band 19 carries rows of spikes 19A which are mounted on strips 19B similarly to the spikes of the first band. The spikes 19A are staggered relative to the spikes 15A so as to be able to pass between the spikes 15A.

As shown in FIG. 2, the adjacent operative runs of the bands 15 and 19 converge slightly in their direction of motion. The angle of inclination B between them may be adjustable to allow for different degrees of teasing of the tobacco. For example, the second band assembly may be pivotally adjustable about the axis of the pulley 20; alternatively, the pulleys 20 and 21 may be carried by a member (not shown) which is adjustable about the axis of the roller 16. In the region 23 (FIG. 2), at the upstream end of the band 19, the spikes 15A and 19A are clear of one another. Downstream of the position 23 the spikes 19A enter progressively into the spaces between the spikes 15A.

The band 19 moves at a slower speed than the band 15; for example, the speed of the band 15 may be up to twice that of the band 19. As a result, the spikes 19A tend to stretch any lumps in the tobacco on the band 15 and generally to tease or loosen the tobacco on the band 15.

The speed of the band 19 relative to that of the band 15 may be adjustable. In general, the difference in speeds between the bands may be made greater for long-strand tobacco and smaller for relatively short-strand tobacco. This is on the basis, for example, that lumps in long-strand tobacco require more stretching; on the other hand, it is desirable to avoid too much stretching, especially in the case of shorter tobacco, since that could result in excessive breakage of the tobacco. Adjustment of the relative speeds of the bands may be provided instead of or in addition to adjustment of the band 19 assembly about the axis of the pulley 20 or roller 16; it will be understood that this latter adjustment also varies the amount by which the tobacco is stretched since it varies the distance along which the spikes of the two bands intercalate as well as the degree of intercalation at the downstream end.

Lumps of tobacco which catch on the spikes 19A of the band 19 are knocked off by the roller 16. Alternatively a separate cleaner roller may be provided for that purpose.

After passing over the upper pulley 18, the tobacco on the band 15 is removed from the band by a flapper roller 23 which has flexible flaps 23A which pass between the spikes on the band 15. The flapper roller (which could be replaced by a picker roller with rigid spikes) projects the tobacco downwards into a trough 24 from which it is projected by a relatively high-speed flapper roller 25 having flexible (or possibly rigid) flaps 25A which extend along the entire length of the trough 24 (i.e. along a distance corresponding to the width of the band 15). The trough 24 has a discharge edge 24A which directs the tobacco in a direction extending slightly upwards. Heavy foreign bodies (and possibly also lumps and heavy pieces of tobacco) are, as a result, thrown over an upper edge 26A of a wall 26, whereas tobacco particles strike the wall 26 and then slide down the wall and into a well 27. An upper portion 26B of the wall 26, is vertically adjustable, being secured to the lower part of the wall by releaseable fastenings 26C whereby the height of the upper edge 26A can be adjusted. The foreign bodies are received by a collector box 26D which is readily removable so that it can be emptied periodically.

As the tobacco arrives in the well 27, it is carried away substantially immediately by a spiked drum 28 which partly defines the well 27. The arrangement is such that the tobacco, which arrives in the well in a relatively loose state, does not pile up on the well but is immediately or substantially immediately carried away by the drum 28. A fixed member 29 forms one boundary wall for the well 27 and extends part of the way around the drum 28.

A picker roller 30 then strips the tobacco from the drum 28 and projects it downwards into the upper end of a downwardly extending channel formed by a front wall 31 and a rear wall 32; entry of the tobacco into the channel may be assisted by means of a roller 31A rotating as shown. Tobacco piles up in the channel to form a column of tobacco which passes downwards through the channel and is removed continuously at the lower end of the column by a spiked drum 33. A picker roller 34 in turn strips the tobacco from the drum 33 and projects it downwards (preferably as a diverging spray) towards a band 35. The band 35 is driven at a speed such that the tobacco particles arriving on it form a loose or open carpet; for example, the speed of the band 35 may be between 3 and 10 feet per second. The upper run of the band 35, which carries the tobacco, is deflected slightly around a pulley 36 to enable the tobacco to be projected slightly dowmwards from the downstream end portion 35A of the band 35 in the direction of the arrow 37. A roller 38 is mounted above the pulley 36 and rotates with a peripheral speed equal to the speed of the band, the purpose of the roller 38 being to ensure that the tobacco follows the path of the band while moving around the pulley 36.

The tobacco projected from the band 35 may, for example, be showered downwards or upwards through a further channel and towards a band on which it builds up into a cigarette filler stream in any well known manner.

In association with the channel 31, 32 there are two position sensing devices 39 and 40 (e.g. capacitance sensing devices) which are intended to ensure that the height of the column of tobacco in the channel 31, 32 remains substantially between upper and lower limits adjacent to the sensing devices 39 and 40 respectively. For this purpose the sensing devices 39 and 40 may be arranged to control the speed of the band 15 (and correspondingly also of the band 19). For example, when the height of the tobacco column in the channel reaches or falls slightly below the sensing device 40, the control circuit may be such that the band 15 has its speed automatically increased; this increased speed (which may be preset, for example, at about 250 mm/sec.) is maintained until the tobacco column in the channel 31, 32 reaches the sensing device 39, whereupon the speed of the band 15 is reduced, for example to a preset level of about 80 mm/sec. The speed of the spiked drum 28 may remain constant, the tobacco carrying capacity of the drum 28 being sufficient to carry away tobacco at the full rate at which tobacco arrives in the well 27 when the band 15 is travelling at its higher or highest speed.

There may be a refuser roller adjacent to the drum 28 and upstream of the picker roller 30 to smooth out the carpet of tobacco on the drum 28 prior to picking.

Preferably the walls 31 and 32 defining the channel in which the tobacco column is formed diverge slightly in a downward direction. Furthermore, the thickness of the column may be adjustable. For this last purpose the rear wall 32 is pivotally mounted on the upper ends of two pairs or sets of levers 41 and 42 respectively, the lower ends 41A and 42A of the levers being pivoted to a stationary frame (not shown). An adjusting screw 43 can therefore move the rear wall 32 towards or away from the wall 31 while maintaining the orientation of the wall 32 as a result of the parallel linkage mechanism provided by the levers 41 and 42. The wall 32 is shown in solid outline at its outermost position, and in broken outline at its innermost position. By way of example, the distance between the walls 31 and 32 may vary from 17 mm to 26 mm at the upper end of the channel and from 21 mm to 30 mm at the lower end of the channel.

Any tobacco shorts which may trickle downwards between the band 12 and the band 15 run down an extension 32A of the wall 32 and into the channel 31, 32.

Figures 3, 4:
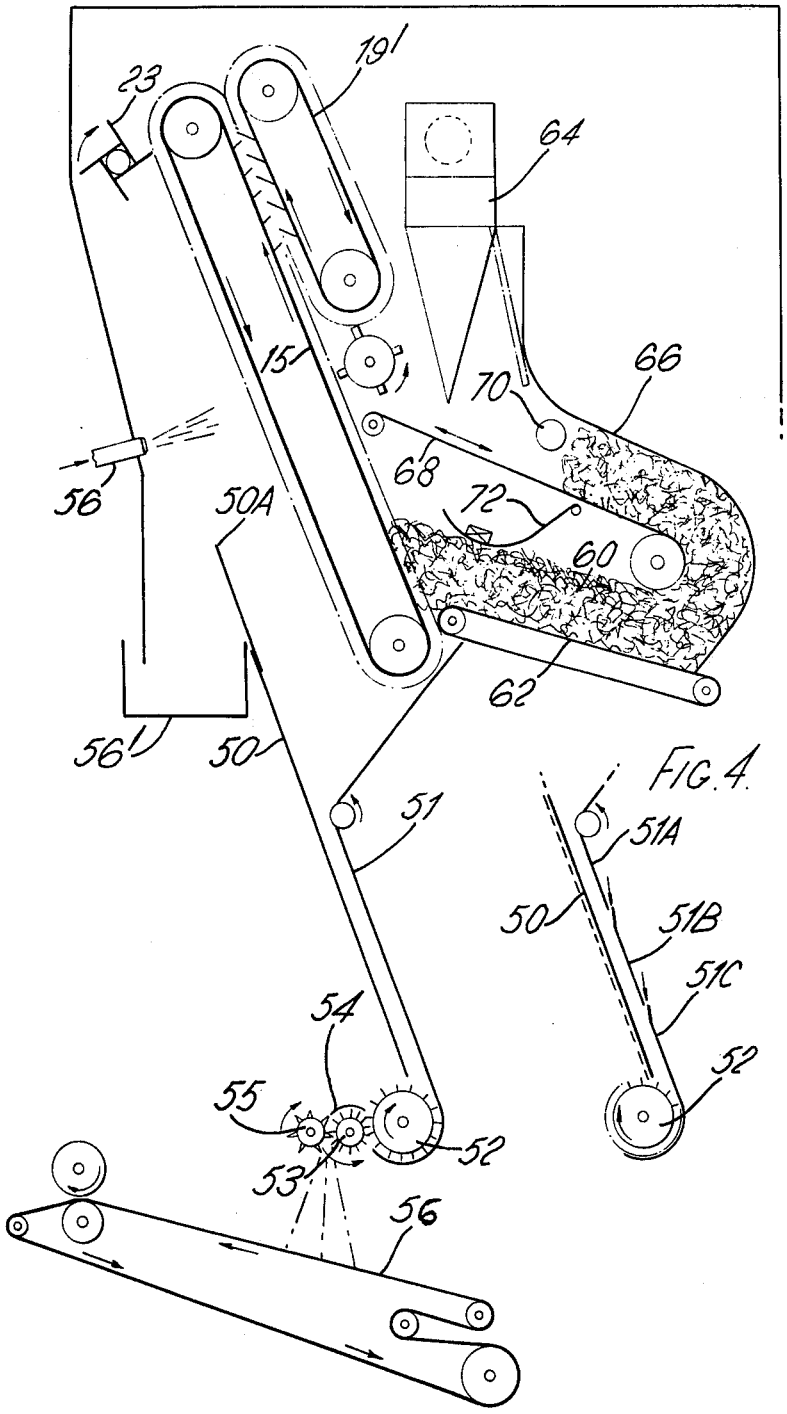
FIG. 3 is a diagrammatic elevation of another hopper.
FIG. 4 is a modification of part of the hopper shown in FIG. 3.

FIG. 3 shows a modified arrangement. In this arrangement tobacco is carried upwards by a band 15 past a cooperating spiked band 19' as in FIG. 1. Again the tobacco is removed from the band 15 by a flapper roller 23. However, in the example shown in FIG. 3, tobacco then enters directly into the upper end of a downwardly extending channel formed by a front wall 50 and a rear wall 51. A column of tobacco thus builds up in the channel 50, 51 the height being controlled as in the example shown in FIG. 1. A spiked drum 52 carries the tobacco from the lower end of the channel as a relatively thick carpet, the width of the channel being at the upperlimit mentioned in relation to FIG. 1 or slightly greater. The relatively thick carpet on the drum 52 is then received by a further spiked drum 53 rotating in the opposite direction to the drum 52 and at a somewhat higher peripheral speed (e.g. about 50% higher). Thus the carpet is stretched and reduced in thickness as it passes from drum 52 to the drum 53. A curved plate 54 helps to keep the tobacco on the drum 53. Finally a picker roller 55 strips the tobacco from the drum 53 and projects it downwards on to a band 56 which may be similar to the band 35 shown in FIG. 1.

In the arrangement shown in FIG. 3 there is also provision for removing heavy foreign bodies. Such bodies are projected downwards by the flapper roller 23 and pass to the left of the upper edge 50A of the channel wall 50 and are collected in a box 56'. Tobacco particles, on the other hand, are blown to the right by a elongated sheetlike air jet directed horizontally to the right from an elongated nozzle 56.

It should be noted that the spikes on the band 19' in FIG. 3, as opposed to those on the band 19 in FIG. 1, are forwardly inclined. The band 19' moves at a somewhat higher speed than the band 15. The pins on the band 15 are slightly forwardly inclined.

Tobacco is delivered to the band 15 as a carpet 60 (for example, 6 inches thick) on a band 62. The tobacco is fed to the band 62 via a feed unit 64 (into which tobacco is fed pneumatically when required) and a channel between a fixed wall 66 and a reciprocating wall 68 which has a low-friction surface coating. The wall 68 reciprocates in its own plane, in a repeated cycle consisting of slow downward strokes and fast upward strokes; for example, it may be driven by a pneumatic jack with a return spring. A detector 70 causes the feed unit 64 to deliver a quantity of tobacco whenever the level of tobacco falls below the detector 70. A weighted flap 72 may be included to press the carpet down lightly.

The arrangement shown in FIG. 3 for feeding tobacco to the band 15 is useful in that it produces a carpet 60 of controlled height and provides a significant total tobacco capacity in a compact configuration.

FIG. 4 shows a modification of the channel of the hopper shown in FIG. 3. Instead of a continuous wall 51, there are three sections 51A, 51B and 51C (though there could be more or fewer) which are spaced by successively increasing distances from the wall 50. At each step between successive sections 51A, 51B, 51C there is a gap through which air may be blown in the direction of the arrows. This reduces the possibility of chokes in the channel. There may also be a gap at the top of the channel to receive another similar air jet. Each section of the wall 51A, 51B, 51C may diverge slightly from the wall 50 in a downward direction.

The following further modification may be possible. Instead of the second spiked band 19, there are two spiked rollers, approximately situated where the pulleys 20 and 21 are shown in the drawings, the spikes of the downstream roller reaching closer to the band 23. The distance of each roller from the band, and its speed, may be adjustable.

We claim:

1. A cigarette machine hopper comprising:

a first continuous band extending along a predetermined path and having an operative run along said path;

b. a second continuous band having a further operative run adjacent to and extending approximately parallel to at least a portion of said operative run of said band;

c. means for driving said first and second bands respectively such that said operative runs move in the same direction at different speeds; and d. means for feeding particulate tobacco onto said first band upstream of said operative run of said second band;

e. said first and second bands each having a plurality of spike means thereon, the spike means of the two bands being angularly arranged to tease said tobacco and stretch any lumps therein as said tobacco is fed along said path between said confronting surfaces of said operative runs.

2. A hopper according to claim 1 further comprising means downstream along said path from said operative run of said second band for removing said tobacco from said first band.

3. A hopper according to claim 2 wherein said driving means is adapted to move said second band at a slower speed than said first band.

4. A hopper according to claim 3 in which said spike means on both said bands are forwardly inclined with respect to the direction of movement of said bands along said operative runs.

5. A hopper according to claim 1 further comprising means defining a downwardly extending channel for receiving a stream of said tobacco from said first band at a position along said path downwstream of said operative run of said second band and for building up said tobacco to form a column of tobacco therein, and means for feeding said tobacco continuously from the lower end of said channel.

6. A hopper according to claim 1 wherein said operative run of said first band is arranged to move upwardly, said feed means comprising a third band having an operative run arranged to move towards said first band and deliver said tobacco to said first band.

7. A hopper according to claim 6 wherein said third band is arranged to deliver said tobacco towards said first band in the form of a carpet of substantially uniform thickness.

8. A cigarette machine hopper comprising:

a. a first continuous band extending along a predetermined path and having an operative run along said path;

b. a second continuous band having a further operative run adjacent to at least a portion of said operative run of said first band, said operative run of said second band being inclined slightly toward said operative run of said first band in the direction of movement of said band;

c. means for driving said first and second bands respectively such that said operative runs move in the same direction at different speeds; and d. means for feeding particulate tobacco onto said first band upstream of said operative run of said second band;

e. said first and second bands each having a plurality of spike means thereon, the spike means of the two bands being angularly arranged to tease said tobacco and stretch any lumps therein as said tobacco is fed along said path between said confronting surfaces of said operative runs.

9. A cigarette machine hopper comprising:

a. first continuous band extending along a predetermined path and having an operative run along said path;

b. a second continuous band having a further operative run adjacent to and extending approximately parallel to at least a portion of said operative run of said first band;

c. means for driving said first and second bands respectively at different speeds;

d. means for feeding particulate tobacco onto said first band upstream of said operative run of said second band;

e. said first and second bands each having a plurality of spikes thereon, the spikes of the two bands being arranged to tease said tobacco and stretch any lumps therein as said tobacco is fed along said path between said confronting surfaces of said operative runs;

f. means defining a downwardly extending channel for receiving a stream of said tobacco from said first band at a position along said path downstream of said operative run of said second band and for building up said tobacco to form a column of tobacco therein, and means for feeding said tobacco continuously from the lower end of said channel; and g. means responsive to the height of said column of tobacco in said channel for controlling the speed of said first band whereby the speed of said first band is dependent upon the height of said column of tobacco.

10. A cigarette machine hopper comprising:

a. a first continuous band extending along a predetermined path and having an operative run along said path;

b. a second continuous band having a further operative run adjacent to and extending approximately parallel to at least a portion of said operative run of said first band;

c. means for driving said first and second bands respectively at different speeds;

d. means for feeding particulate tobacco onto said first band upstream of said operative run of said second band; e. said first and second bands each having a plurality of spikes thereon, the spikes of the two bands being arranged to tease said tobacco and stretch any lumps therein as said tobacco is fed along said path between said confronting surfaces of said operative runs;

f. means defining a downwardly extending channel for receiving a stream of said tobacco from said first band at a position along said path downstream of said operative run of said second band and for building up said tobacco to form a column of tobacco therein, and means for feeding said tobacco continuously from the lower end of said channel; and g. a wall extending upwardly above said channel and means for projecting said stream of tobacco received from said first band in a direction such that foreign bodies contained in said tobacco are projected over the top of said wall while said tobacco is projected against said wall and slides down said wall towards said channel.

11. A hopper according to claim 10 further comprising a rotatable spiked drum positioned at the bottom of said wall for receiving said tobacco and a rotatable picker roller for removing said tobacco from said spiked drum and projecting said tobacco into said channel.

12. A cigarette machine hopper comprising:

a. a first continuous band extending along a predetermined path and having an operative run along said path;

b. a second continuous band having a further operative run adjacent to and extending approximately parallel to at least a portion of said operative run of said first band;

c. means for driving said first and second bands respectively at different speeds;

d. means for feeding particulate tobacco onto said first band upstream of said operative run of said second band;

e. said first and second bands each having a plurality of spikes thereon, the spikes of the two bands being arranged to tease said tobacco and stretch any lumps therein as said tobacco is fed along said path between said confronting surfaces of said operative runs;

f. means defining a downwardly extending channel for receiving a stream of said tobacco from said first band at a position along said path downstream of said operative run of said second band and for building up said tobacco to form a column of tobacco therein, and means for feeding said tobacco continuously from the lower end of said channel; and g. a wall extending upwardly above said channel and means for projecting a sheet-like jet of air in a direction transverse to the stream of tobacco descending from said band and sufficient to blow normal tobacco contained in said stream over the top of said wall to feed said tobacco downwardly into said channel but insufficient to blow any foreign bodies contained in said stream over the top of said wall whereby said foreign bodies fall down the opposite side of said wall.

13. A cigarette machine hopper comprising:

a. a first continuous band extending along a predetermined path and having an operative run along said path, said operative run of said first band being arranged to move upwardly;

b. a second continuous band having a further operative run adjacent to and extending approximately parallel to at least a portion of said operative run of said first band;

c. means for driving said first and second bands respectively such that said operative runs move in the same direction at different speeds; and d. a third band having an operative run arranged to move towards said first band and deliver said tobacco to said first band in the form of a carpet having a substantially uniform thickness of approximately 50 to 200 mm;

e. said first and second bands each having a plurality of spike means thereon, the spike means of the two bands being angularly arranged to tease said tobacco and stretch any lumps therein as said tobacco is fed along said path between said confronting surfaces of said operative runs.

14. A cigarette machine hopper comprising:

a. a first continuous band extending along a predetermined path and having an operative run along said path, said operative run of said first band being arranged to move upwardly;

b. a second continuous band having a further operative run adjacent to and extending approximately parallel to at least a portion of said operative run of said first band;

c. means for driving said first and second bands respectively at different speeds;

d. a third band having an operative run arranged to move towards said first band and deliver said tobacco to said first band;

e. said first and second bands each having a plurality of spikes thereon, the spikes of the two bands being arranged to tease said tobacco and stretch any lumps therein as said tobacco is fed along said path between said confronting surfaces of said operative runs;

f. means defining a downwardly extending channel for receiving a stream of said tobacco from said first band at a position along said path downstream of said operative run of said first band and for forming therein a column of tobacco, means for feeding tobacco continuously from the lower end of said channel, and a wall extending obliquely upwardly to a position below the adjacent parts of said first and third bands for directing into said channel any particles of tobacco passing downwardly between said first and third bands.

15. A cigarette machine hopper comprising:

a. a first continuous band extending along a predetermined path and having an operative run along said path, said band including a plurality of angularly arranged spike means thereon;

b. means for feeding particulate tobacco onto said operative run of said first band;

c. means for removing excess tobacco from said first band;

d. a second continuous band having a further operative run adjacent to and approximately parallel to said operative run of said first band, said second band having a plurality of angularly arranged spike means thereon, said further operative run of said second band being in a region along said path downstream of said excess tobacco removing means; and e. means for driving said first and second bands respectively such that said operative runs move in the same direction at different speeds;

f. whereby, due to the relative motion of said operative runs of said bands, said spike means on said two bands cooperate to tease said tobacco and stretch any lumps therein as said tobacco is fed along said path between said operative runs of said bands.

* * * * *